US005451143A

United States Patent [19]

Lin

[11] Patent Number: 5,451,143

[45] Date of Patent: Sep. 19, 1995

[54] MOTORBOAT IMPELLER

[76] Inventor: Solas Y. J. Lin, 37, 35th Road Taichung Industrial Park, Taichung, Taiwan

[21] Appl. No.: 233,804

[22] Filed: Apr. 26, 1994

[51] Int. Cl.[6] ..... B63H 23/34

[52] U.S. Cl. ..... 416/244 B; 416/245 A

[58] Field of Search ..... 416/244 B, 245 A, 224, 416/229 R, 188, 244 R, 245 R, 93 A

[56] References Cited

U.S. PATENT DOCUMENTS

| | | | |
|---|---|---|---|
| 934,633 | 9/1909 | Scott | 416/245 A |
| 2,443,688 | 6/1948 | McFarland | 416/244 R |
| 3,542,487 | 11/1970 | Knuth | 416/93 |
| 3,865,509 | 2/1975 | Frazzell et al. | 416/93 A |
| 4,789,303 | 12/1988 | Frazzell et al. | 416/244 B |

*Primary Examiner*—Edward K. Look

*Assistant Examiner*—James A. Larson

*Attorney, Agent, or Firm*—Browdy and Neimark

[57] ABSTRACT

A motorboat impeller comprises an axial portion, a plurality of blades attached to the periphery of the axial portion, an axial casing, and a nose. The axial portion of a conical construction has a front end with an outer diameter smaller than an outer diameter of a rear end thereof and further has a first axial hole extending therethrough. The axial casing is fastened to the inside of the front end of the first axial hole and is harder in quality than the axial portion. The axial casing is provided therethrough with a second axial hole having in the inner wall thereof a plurality of retaining slots engageable with the splines of a driveshaft. The nose of an elastic material is attached to the front end of the axial portion so that the axial portion has a streamline profile.

4 Claims, 3 Drawing Sheets

MOTORBOAT IMPELLER

FIELD OF THE INVENTION

The present invention relates generally to the impeller of a motorboat, and more particularly to an improved streamline impeller of a motorboat.

BACKGROUND OF THE INVENTION

Generally speaking, there are two methods by which the motorboat impeller is fastened with the motorboat driveshaft. The first method includes a impeller which is provided centrally with a threaded axial hole engageable with a threaded portion located at the tail end of a driveshaft. The second method includes a impeller which is provided centrally with an axial hole having therein a predetermined number of serrated slots which extend along the direction of the axis of the axial hole and which are engageable with splines disposed on the tail end of a driveshaft. The motorboat impeller of the present invention relates to the second fastening method described above.

As shown in FIGS. 1 and 2, a conventional motorboat impeller 10 of the prior art comprises an axial portion 12 and a plurality of blades 14 fastened around the periphery of the axial portion 12 of a cylindrical construction. The axial portion 12 has a rather round and smooth front end and is provided centrally with an axial hole 16 extending therethrough along the direction of the axis thereof. The axial hole 16 is provided on the inner wall thereof with a plurality of retaining slots 18 of an appropriate length and extending rearward from the front end of the axial hole 16 along the direction of the axis of the axial hole 16. A motorboat driveshaft (not shown in the drawings) provided at the tail end thereof with splines is fitted into the front end of the axial hole 16 for driving the impeller 10.

The axial portion 12 and the blades 14 of the motorboat impeller 10 are made integrally. The axial portion 12 is provided centrally with the axial hole 16. The portion between the outer surface of the axial portion 12 and the inner wall surface of the axial hole 16 is rather thick so as to facilitate the construction of the retaining slots 18 in the inner wall of the front end of the axial hole 16 with a cutting tool.

The motorboat impeller 10 of the prior art described above has inherent shortcomings, which are expounded explicitly hereinafter.

It is rather time-consuming to construct the retaining slots 18 in the inner wall of the axial hole 16 with a cutting tool.

It is technically difficult to construct the retaining slots 18 with a cutting tool in such a manner that they are arranged equidistantly and circularly in the inner wall of the front end of the axial hole 16.

The cutting tool used to construct the retaining slots 18 is subjected to abrasion after a prolonged usage thereof. As a result, the retaining slots 18 constructed with such a defective cutting tool are bound to have an incorrect dimension. If the dimension of the retaining slots 18 is smaller than a predetermined value, the driveshaft can not be fitted thereinto. If the dimension of the retaining slots 18 is greater than the predetermined value, the splines of the driveshaft fitted into the axial hole 16 are bound to damage the inner wall of the axial hole 16.

It is impractical and uneconomical to use a rigid material to make the axial portion 12 for preventing the retaining slots 18 from being damaged by the splines of the driveshaft in view of the fact that the axial portion 12 is made integrally with the blades 14 which are not subjected to impact force of the splines of the driveshaft. As a result, it is rather wasteful to use an expensive and rigid material to make the axial portion 12 and the blades 14.

The structural strength of the axial portion 12 may be enhanced by an increase in the thickness of the axial portion 12. However, the increase in the thickness of the axial portion 12 results in the formation of a shoulder surface 121 at the front end of the axial portion 12. The shoulder surface 121 is responsible for the formation of water bubbles, turbulent waves and cavitation at the time when the motorboat impeller 10 of the prior art is driven by the driveshaft to turn at a high speed in the water. In other words, the operation of the prior art motorboat impeller 10 can bring about a severe vibration of the motorboat and a substantial reduction in the thrust of the impeller 10.

SUMMARY OF THE INVENTION

It is therefore the primary objective of the present invention to provide the axial portion of a motorboat with retaining slots having a precise dimension as required.

It is another objective of the present invention to provide the axial portion of a motorboat impeller with a front end which is made of a relatively rigid material and which is fitted over a driveshaft.

It is still another objective of the present invention to provide a motorboat impeller with a streamline profile capable of reducing the force of resistance and of preventing the water from entering the interior of the axial portion of the motorboat impeller.

The foregoing objectives of the present invention are attained by a motorboat impeller which comprises an axial portion and a plurality of blades fastened around the periphery of the axial portion. The axial portion is provided centrally with a through axial hole having at the front end thereof an axial casing of a hardness greater than that of the axial portion which is further provided with a second axial hole having therein a plurality of retaining slots.

DETAILED DESCRIPTION OF THE INVENTION

Figure 1:
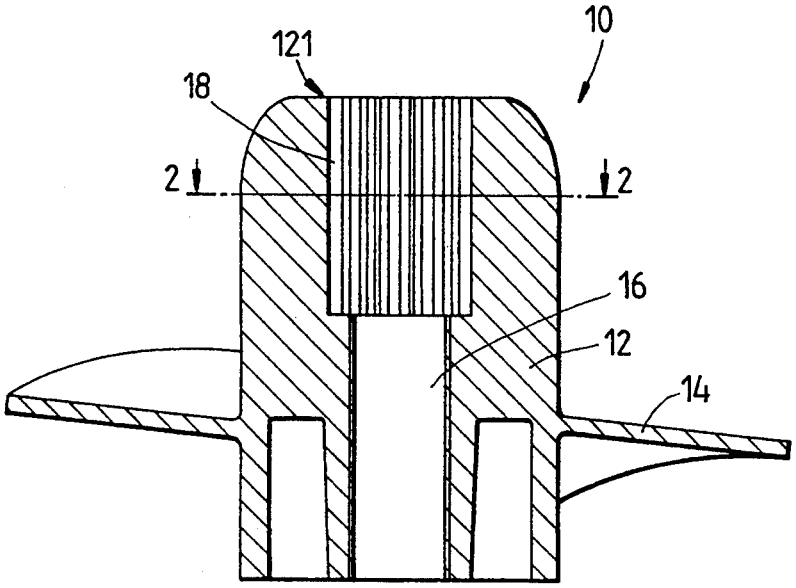
FIG. 1 PRIOR ART
FIG. 1 shows a sectional view taken along the direction of the axis of a motorboat impeller of the prior art.
Figure 2:
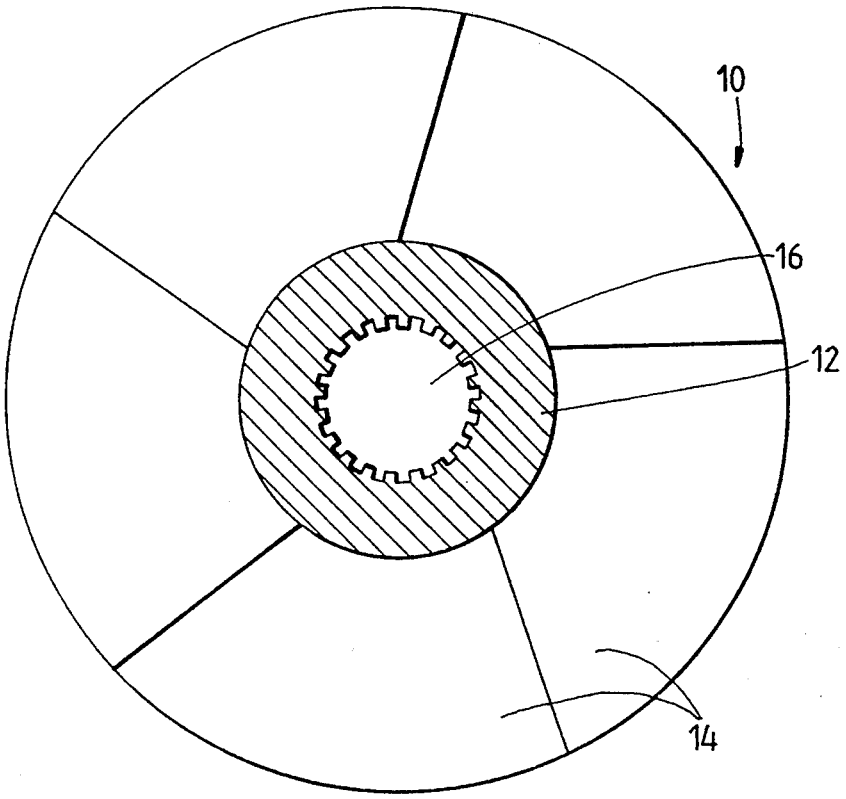
FIG. 2 PRIOR ART
FIG. 2 shows a sectional view taken along the direction indicated by the line 2—2 as shown in FIG. 1.
Figure 3:
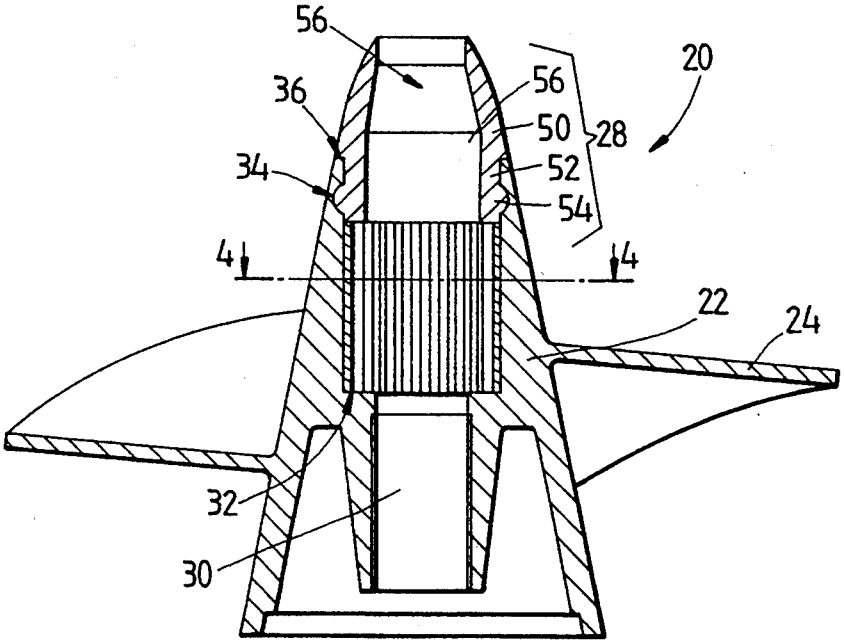
FIG. 3 shows a sectional view taken along the direction of the axis of a motorboat impeller of the present invention.
Figure 4:
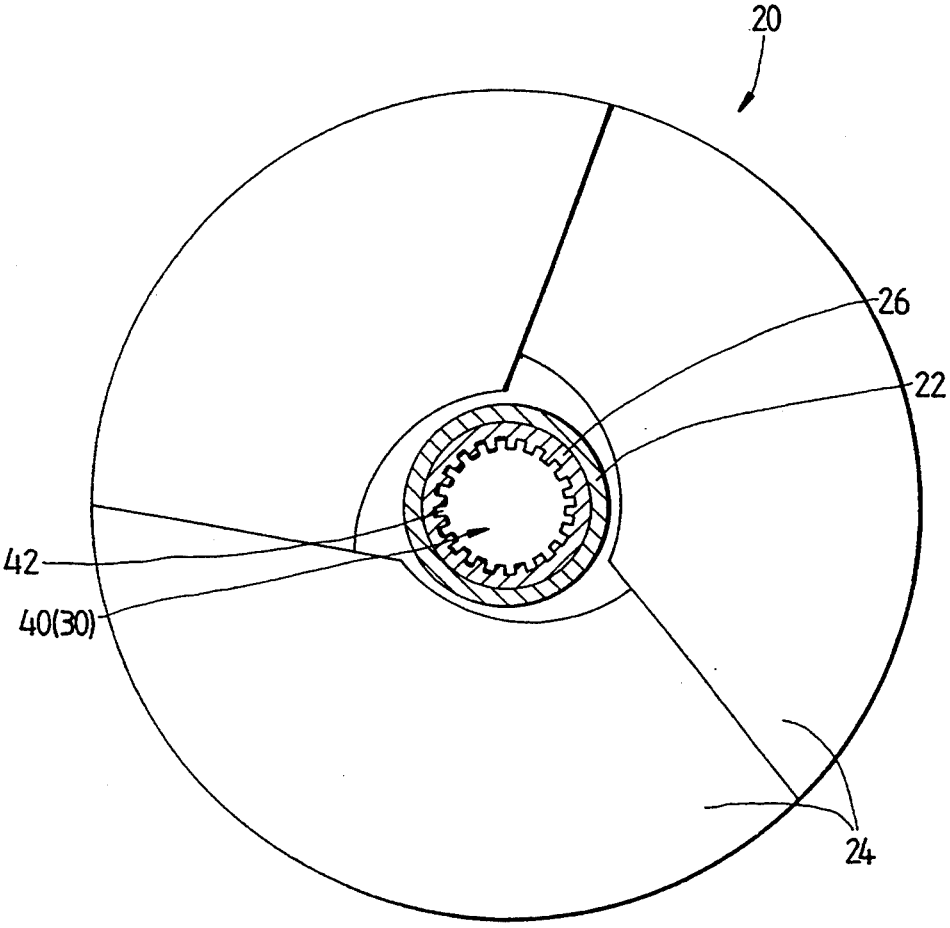
FIG. 4 shows a sectional view taken along the direction indicated by the line 4—4 as shown in FIG. 3.
Figure 5:
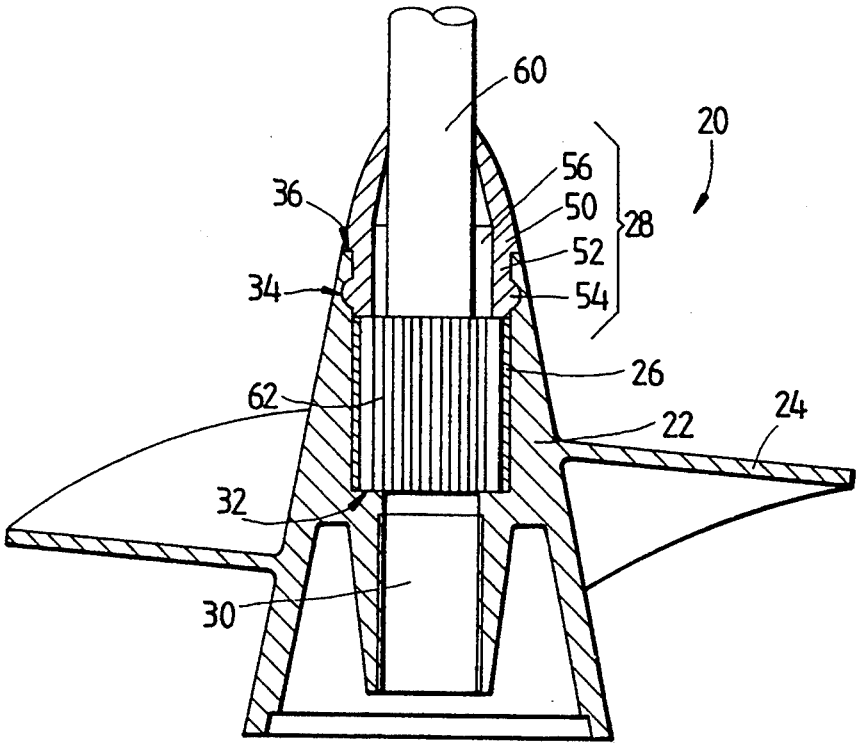
FIG. 5 shows a sectional view taken along the direction of the axis of the motorboat impeller fastened to a driveshaft, according to the present invention.

Referring to FIGS. 3–5, a motorboat impeller 20 embodied in the present invention is shown comprising an axial portion 22, three blades 24, an axial casing 26, and a fitting member 28.

The axial portion 22 is of a conical construction and has a front end with an outer diameter smaller than an outer diameter of a rear end thereof. The axial portion 22 is provided centrally with a first axial hole 30 extending through the axial portion 22. The first axial hole 30 has a front segment with an inner diameter greater than an inner diameter of a rear segment thereof. Located at the junction between the front segment and the rear segment of the first axial hole 30 is a first shoulder 32. The first axial hole 30 is provided in the inner wall of the front segment thereof with an annular slot 34. The axial portion 22 is provided at the front end edge thereof with a second shoulder 36. The blades 24 are made integrally with the axial portion 22.

The axial casing 26 is made of a material having a hardness of HRC 59 or over. Before being joined with the axial portion 22, the axial casing 26 is frozen at an appropriate temperature while the axial portion 22 is baked at an appropriate temperature. Thereafter, the frozen axial casing 26 is put into the front end of the first axial hole 30. Upon reaching the room temperature, the axial casing 26 and the first axial hole 30 are united securely such that the rear end edge of the axial casing 26 presses against the first shoulder 32, and that the front end edge of the axial casing 26 is separated respectively by an appropriate distance from the front end edge of the axial portion 22 and the annular slot 34. In addition, the axial casing 26 is provided with a through second axial hole 40 having a plurality of retaining slots 42 located equidistantly around the inner wall thereof.

A driveshaft 60 has a tail end, which is fitted into the axial casing 26 such that the splines 62 of the driveshaft 60 are lodged in the retaining slots 42. The splines 62 are disposed annularly around the tail end of the driveshaft 60 along the direction of the axis of the driveshaft 60. The first axial hole 30 is protected by the axial casing 26 made of a material having a greater hardness. As a result, the first axial hole 30 is not subjected to the impact force of the splines 62.

The fitting member 28 is made of a rubber material and provided with a nose 50 of a conical construction and having a front end with an outer diameter smaller than an outer diameter of a rear end thereof. Furthermore, the outer diameter of the rear end of the nose 50 is equal to the outer diameter of the front end of the axial portion 22. The fitting member 28 is further provided with a fastening portion 52 and a third axial hole 56 extending through the nose 50 and the fastening portion 52. The fastening portion 52 has a predetermined length extending rearward from the rear end of the nose 50 and has an outer diameter equal to the inner diameter of the front segment of the first axial hole 30. The fastening portion 52 is provided on the outer edge thereof with a flange 54.

The fastening portion 52 of the fitting member 28 is received in the front end of the first axial hole 30 such that the flange 54 engages the annular slot 34, and that the rear end edge of the nose 50 presses against the second shoulder 36. As a result, the axial portion 22 has a rather streamline profile. In addition, the front end of the third axial hole 56 has an inner diameter equal to the outer diameter of the driveshaft 60, thereby preventing the water from entering the interior of the axial portion 22.

What is claimed is:

1. A motor boat impeller comprising:

an axial portion of a conical construction and having a front end with an outer diameter smaller than an outer diameter of a rear end thereof, said axial portion having centrally a first axial hole extending therethrough;

a plurality of blades fastened around the periphery of said axial portion; and an axial casing fastened to the inside of a front end of said first axial hole and made of a material having a hardness greater than that of a material of which said axial portion is made, said axial casing having a second axial hole extending therethrough and having in the inner wall thereof a plurality of retaining slots disposed equidistantly along the direction of the axis of said second axial hole;

wherein said front end of said axial portion has an edge that is separated by a predetermined distance from an edge of a front end of said axial casing; and wherein said first axial hole is fastened with a fitting member which comprises a nose, a fastening portion and a third axial hole, said nose having a front end with an outer diameter smaller than an outer diameter of a rear end thereof, said fastening portion being connected with said rear end of said nose and having an outer diameter smaller than said outer diameter of said rear end of said nose, said fastening portion being so dimensioned as to fit into a front end of said first axial hole, said third axial hole extending through said nose and said fastening portion.

2. The motorboat impeller of claim 1 wherein said outer diameter of said rear end of said nose is equal to said outer diameter of said front end of said axial portion.

3. The motorboat impeller of claim 1 wherein said axial portion has an annular slot located in the inner wall of said first axial hole, and between the edge of said front end of said axial portion and the edge of the front end of said axial casing; and wherein said fastening portion of said fitting member is provided on an outer edge thereof with a flange engageable with said annular slot of said axial portion.

4. The motorboat impeller of claim 1 wherein said first axial hole has a front segment with an inner diameter greater than an inner diameter of a rear segment thereof, said first axial hole further having therein a shoulder which is located at the junction between said front segment and said rear segment and is pressed against by the edge of a rear end of said axial casing.

* * * * *